US007475442B1

(12) United States Patent
Dierking et al.

(10) Patent No.: US 7,475,442 B1
(45) Date of Patent: Jan. 13, 2009

(54) BABY SOOTHING APPARATUS

(76) Inventors: Daniel Dierking, 1155 S. State St., Unit 405, Chicago, IL (US) 60605; Elizabeth Dierking, 1155 S. State St., Chicago, IL (US) 60605

( * ) Notice: Subject to any disclaimer, the term of this patent is extended or adjusted under 35 U.S.C. 154(b) by 0 days.

(21) Appl. No.: 11/943,300

(22) Filed: Nov. 20, 2007

(51) Int. Cl.
*A47C 27/08* (2006.01)
*A47D 13/00* (2006.01)

(52) U.S. Cl. ..... 5/655; 5/655.3; 5/648; 297/440.14; 297/452.41; 472/134; 446/220

(58) Field of Classification Search ..... 5/655.3, 5/655, 706, 644, 648; 297/440.14, 452.41; 482/23, 26, 111; 446/220, 223, 225, 226; 472/134
See application file for complete search history.

(56) References Cited

U.S. PATENT DOCUMENTS 2,987,735 A * 6/1961 Nail ..... 428/12
5,097,553 A * 3/1992 Boland ..... 5/648
5,611,601 A * 3/1997 Cowgur ..... 297/393
D424,822 S 5/2000 Lewis
6,117,095 A * 9/2000 Daggett et al. ..... 602/19
6,328,385 B1 12/2001 Lau
6,390,559 B1 5/2002 Schnitzhofer
6,520,578 B1 2/2003 Jospa et al.
6,647,573 B2 * 11/2003 Corbin ..... 5/655.3
6,679,817 B1 1/2004 Williams
6,929,588 B2 * 8/2005 Hobson ..... 482/138
7,131,701 B1 11/2006 Yang
7,216,385 B2 * 5/2007 Hill ..... 5/624

* cited by examiner

*Primary Examiner*—Alexander Grosz
(74) *Attorney, Agent, or Firm*—Crossley Patent Law; Mark A. Crossley

(57) ABSTRACT

A baby soothing apparatus that is an inflatable, hollow cube made from a single, homogeneous layer of flexible material and the can be used to soothe a baby by being held by an adult user sitting on the inflatable device. As the apparatus is cubical, a more stable base is provided for individuals who have trouble balancing on an exercise ball. Within the cube, the top and bottom surfaces of the cube are thicker to limit their flexibility, while the side surfaces are thinner to allow them to flex outward when an individual is using the apparatus.

3 Claims, 2 Drawing Sheets

BABY SOOTHING APPARATUS

TO ALL WHOM IT MAY CONCERN

Be it known that we, Daniel & Elizabeth Dierking, citizens of the United States, have invented new and useful improvements in a baby soothing apparatus as described in this specification.

BACKGROUND OF THE INVENTION

The present invention concerns that of a new and improved baby soothing apparatus that is an inflatable cubic device made from a single, homogeneous layer of flexible material that can be used to bounce and soothe an infant and which can also be used in lieu of an exercise or therapy ball.

SUMMARY OF THE INVENTION

The present invention concerns that of a new and improved baby soothing apparatus that is designed to be in the shape of an inflatable, hollow cube that can be used to bounce and provide a soothing, comforting motion to an infant and which can also be used in lieu of an exercise or therapy ball. As the apparatus is cubical, the base is more stable than a round base, e.g. a round exercise ball. Thus, the present baby soothing apparatus provides a stable base upon which an individual can sit to bounce and soothe a baby. The cubical design also provides a more stable base than a round base for an individual who wishes to exercise, but who has trouble balancing on an exercise ball. Within the cube, the top and bottom surfaces of the cube are thicker to limit their flexibility, while the side surfaces are thinner to allow them to flex outward when an individual is using the apparatus either to bounce and soothe a baby or to exercise.

There has thus been outlined, rather broadly, the more important features of a baby soothing apparatus that the detailed description thereof that follows may be better understood and in order that the present contribution to the art may be better appreciated. There are, of course, additional features of the baby soothing apparatus that will be described hereinafter and which will form the subject matter of the claims appended hereto.

In this respect, before explaining at least one embodiment of the baby soothing apparatus in detail, it is to be understood that the baby soothing apparatus is not limited in its application to the details of construction and to the arrangements of the components set forth in the following description or illustrated in the drawings. The baby soothing apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the baby soothing apparatus. It is important, therefore, that the claims be regarded as including such equivalent constructions insofar as they do not depart from the spirit and scope of the present invention.

An object of the present baby soothing apparatus is to provide an apparatus upon which an individual may gently bounce, comfort, and soothe a baby while holding a baby.

Another object of the present baby soothing apparatus is to provide a therapeutic exercise device.

Still another object of the present baby soothing apparatus is to provide an exercise device to an individual who is unable to use an exercise or round therapy ball.

Even another object of the present baby soothing apparatus is to provide a seat.

Still even another object of the present baby soothing apparatus is to provide therapy for an individual with postural deficits and/or poor muscle tone.

Yet another object of the present baby soothing apparatus is to provide a stable base upon which an individual may bounce and soothe a baby or upon which an individual may exercise.

Yet even another object of the present baby soothing apparatus is to provide a baby soothing apparatus which has all of the advantages of the prior art and none of the disadvantages.

Still even another object of the present baby soothing apparatus is to provide baby soothing apparatus which may be easily and efficiently manufactured and marketed.

Still yet another object of the present baby soothing apparatus is to provide a baby soothing apparatus which is of durable and reliable construction.

It is yet a further object of the present baby soothing apparatus to provide a baby soothing apparatus which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
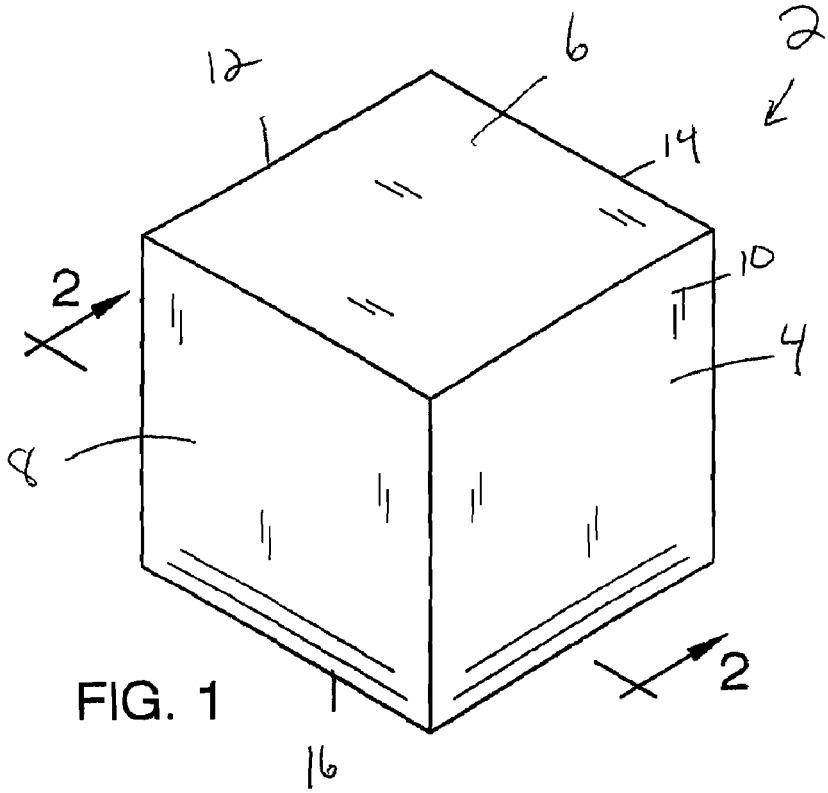
FIG. 1 shows a top perspective view of the baby soothing apparatus.

With reference now to the drawings, and in particular to FIGS. 1 through 4 thereof, a new baby soothing apparatus embodying the principles and concepts of the present invention and generally designated by the reference numeral 2 will be described.

Figure 2:
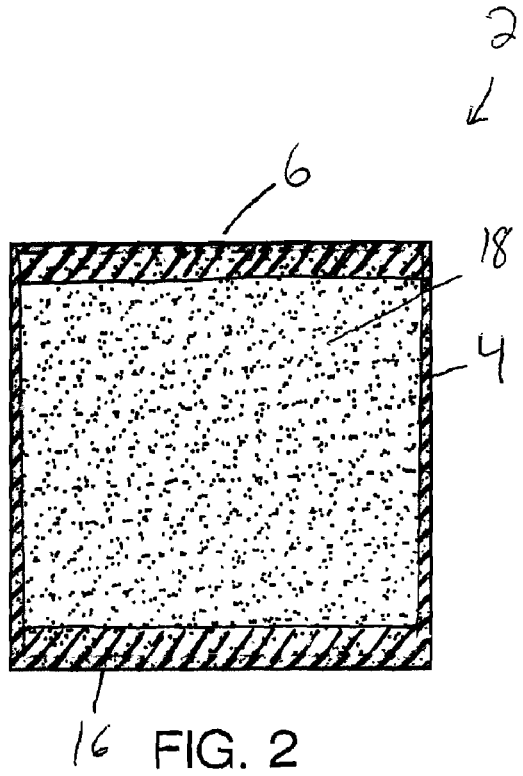
FIG. 2 shows a side cutaway view of the baby soothing apparatus.

As best illustrated in FIGS. 1 through 4, the baby soothing apparatus 2 comprises a flexible, inflatable cube 4 made from a single, homogeneous layer of flexible material, as seen in FIG. 2, that has six surfaces comprising a top surface 6, a first side surface 8, a second side surface 10, a third side surface 12, a fourth side surface 14, and a bottom surface 16. The top surface 6 of the cube 4 is connected to each of the side surfaces 8-14, while the bottom surface 16 of the cube 4 is connected to each of the side surfaces 8-14. Furthermore, the cube has a height, width, and depth measurements, which would be all the same in relation to one another.

Each of the six surfaces has a thickness. Preferably, the thickness of the top surface 6 and the bottom surface 16 are greater than that of each of the four side surfaces. By having a greater thickness, the flexibility of the top surface 6 and the bottom surface 16 is limited, thereby helping to assist in the structural support of the baby soothing apparatus 2. The cubical structure provides a more stable base than conventional round exercise or therapy balls.

The cube 4 itself has a volume of air 18 within it. The air 18 is pressurized to a certain pressure level, preferably above that of standard atmospheric pressure, which gives the cube 4 enough structure to allow people to sit on the cube 4 and use it for a wide variety of purposes.

The cube 4 of the apparatus 2 could also be used as an educational tool. The cube 4, in one embodiment of such a tool, would have one or more letters 20 placed on one or more of the side surfaces 8-14.

Figure 3:
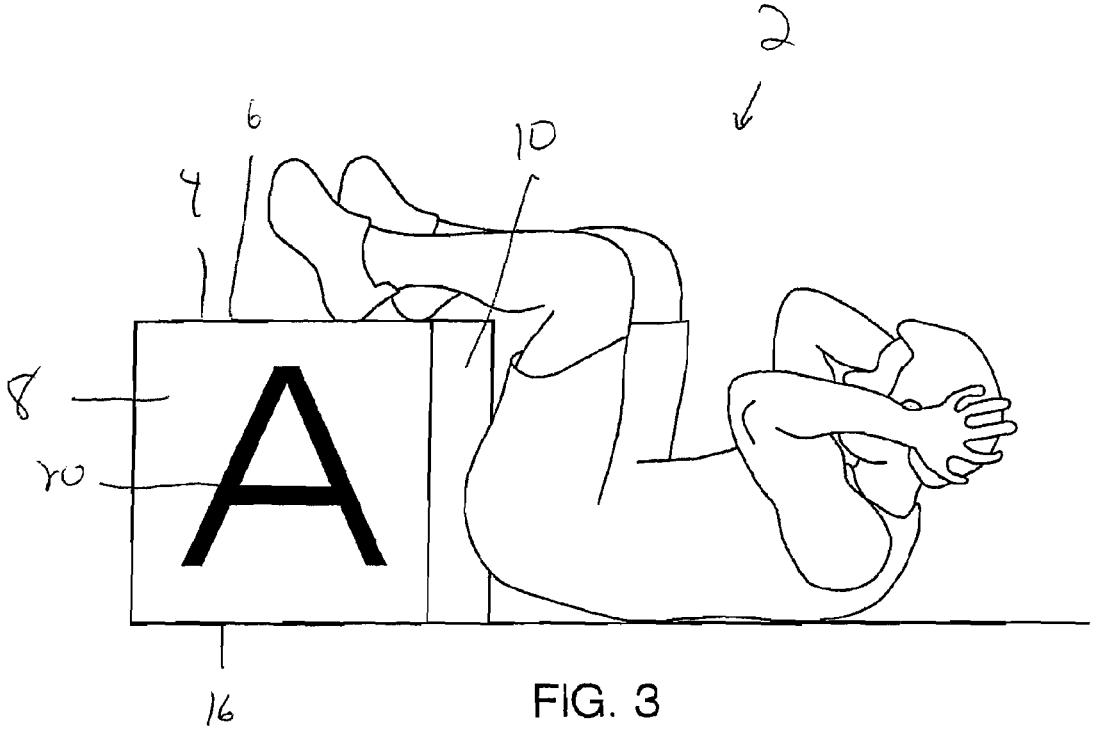
FIG. 3 shows a representative view of one possible use of the baby soothing apparatus as an individual is exercising using the apparatus as a foot support.
Figure 4:
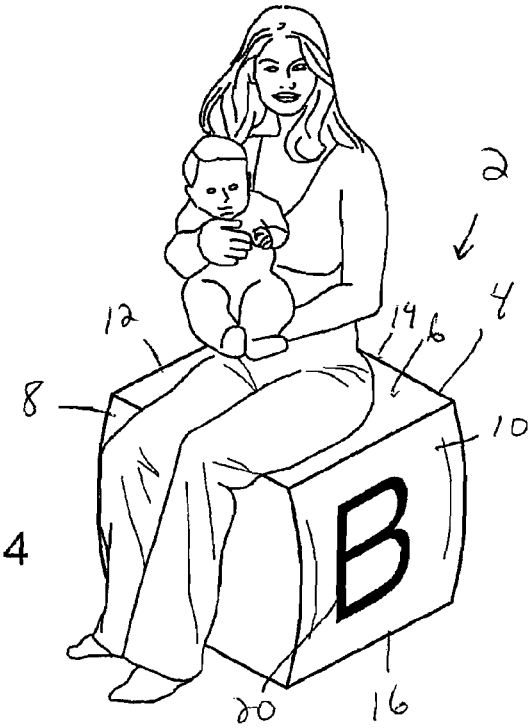
FIG. 4 shows a perspective view of use illustrating a woman holding an infant to soothe a baby and gently pressing down on the apparatus.

The cube 4 itself can be used for a wide variety of purposes in addition to that of exercise, as illustrated in FIG. 3, or to permit a baby to be soothed by an adult user sitting on the inflatable device while holding the soothing, as illustrated in FIG. 4. The cube 4 may be used for therapy for an individual who has a postural problem or poor muscle tone. In addition, the cube 4 may be used as general use as a seat. Each square face of the cube 4 can have a wide variety of heighths and widths, but preferably the cube 4 comes in one of three standard sizes—22 inch, 26 inch, or 30 inch. Each of these dimensions would be the height, width, or depth of any dimension of the cube 4.

With respect to the above description then, it is to be realized that the optimum dimensional relationships for the parts of the present apparatus to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A baby soothing apparatus adapted to soothe an infant held by an adult sitting on the apparatus, the apparatus comprising (a) an inflatable object, the inflatable object comprising an inflatable cube, the inflatable cube further comprising (i) a top surface, (ii) a bottom surface, (iii) a first side surface connected to both the top surface and the bottom surface, (iv) a second side surface connected to both the top surface and the bottom surface, (v) a third side surface connected to both the top surface and the bottom surface, and (vi) a fourth side surface connected to both the top surface and the bottom surface, (vii) wherein each of the six surfaces has a thickness, (viii) further wherein the top surface and the bottom surface of the inflatable cube each have a thickness thicker than the thickness of each of the four side surfaces, (ix) further wherein the inflatable cube has a height of at least twenty two inches, (x) further wherein the inflatable cube has a depth, (xi) further wherein the inflatable cube has a width, (xii) further wherein the inflatable cube is constructed of a homogeneous, single layer of flexible material, (b) wherein the inflatable object comprises a volume of gas located within the inflatable object, the volume of gas comprising a volume of air, wherein the volume of air is pressurized to a level above that of standard atmospheric pressure, (c) at least one written object located on at least one side surface of the cube, wherein the written object comprises a letter.

2. A baby soothing apparatus according to claim 1 wherein a letter is written on at least one side of the inflatable cube.

3. A baby soothing apparatus according to claim 1 wherein the cube has a height of twenty six (26) inches.

* * * * *